US009909083B2

(12) United States Patent
Takeshima

(10) Patent No.: US 9,909,083 B2
(45) Date of Patent: Mar. 6, 2018

(54) SYSTEM LUBRICATING OIL COMPOSITION FOR CROSSHEAD DIESEL ENGINE

(71) Applicant: JX Nippon Oil & Energy Corporation, Chiyoda-ku, Tokyo (JP)

(72) Inventor: Shigeki Takeshima, Chigasaki (JP)

(73) Assignee: JX Nippon Oil & Energy Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 14/655,843

(22) PCT Filed: Dec. 17, 2013

(86) PCT No.: PCT/JP2013/007413

§ 371 (c)(1),
(2) Date: Jun. 26, 2015

(87) PCT Pub. No.: WO2014/103244

PCT Pub. Date: Jul. 3, 2014

(65) Prior Publication Data

US 2015/0344807 A1 Dec. 3, 2015

(30) Foreign Application Priority Data

Dec. 27, 2012 (JP) ..... 2012-286117
Dec. 27, 2012 (JP) ..... 2012-286120

(51) Int. Cl.
*C10M 161/00* (2006.01)
*C10M 163/00* (2006.01)
*C10M 169/04* (2006.01)

(52) U.S. Cl.
CPC ..... *C10M 161/00* (2013.01); *C10M 163/00* (2013.01); *C10M 169/045* (2013.01); *C10M 2203/1025* (2013.01); *C10M 2207/026* (2013.01); *C10M 2207/262* (2013.01); *C10M 2215/064* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10M 2227/09* (2013.01); *C10N 2210/02* (2013.01); *C10N 2210/06* (2013.01); *C10N 2220/022* (2013.01); *C10N 2230/02* (2013.01); *C10N 2230/04* (2013.01); *C10N 2230/08* (2013.01); *C10N 2230/10* (2013.01); *C10N 2230/42* (2013.01); *C10N 2230/52* (2013.01); *C10N 2240/102* (2013.01)

(58) Field of Classification Search
CPC ..... C10M 161/00; C10M 163/00; C10M 169/045; C10M 2203/1025; C10M 2207/262; C10M 2215/064; C10M 2215/28; C10M 2219/046; C10M 2219/068; C10M 2223/045; C10M 2227/066; C10M 2227/09; C10N 2210/02; C10N 2210/06; C10N 2220/022; C10N 2230/02; C10N 2230/04; C10N 2230/08; C10N 2230/42; C10N 2240/102; C10N 2230/10; C10N 2230/52
See application file for complete search history.

(56) References Cited

U.S. PATENT DOCUMENTS 7,838,709 B2 * 11/2010 Matsui ..... C10M 101/00 208/33
2011/0077179 A1 3/2011 Van Houten et al.

FOREIGN PATENT DOCUMENTS

| | | | |
|---|---|---|---|
| CN | 101379171 | A | 3/2009 |
| CN | 101586050 | A | 11/2009 |
| CN | 102549129 | A | 7/2012 |
| EP | 1167497 | A2 | 1/2002 |
| EP | 1439217 | A1 | 7/2004 |
| EP | 2123739 | A1 | 11/2009 |
| JP | 2002-275491 | A | 9/2002 |
| JP | 2006-241436 | A | 9/2006 |
| JP | 2007-231115 | A | 9/2007 |
| JP | 2007-246659 | A | 9/2007 |
| JP | 2009-185293 | A | 8/2009 |
| JP | 2010-519376 | A | 6/2010 |
| JP | 2010-523733 | A | 7/2010 |
| JP | 2011-032406 | A | 2/2011 |
| JP | 2011032406 | * | 2/2011 |

(Continued)

OTHER PUBLICATIONS

Mar. 25, 2014 International Search Report issued in International Patent Application No. PCT/JP2013/007413.
Oct. 11, 2016, Office Action issued by the State Intellectual Property Office in the corresponding Chinese Patent Application No. 201380073805.2.
Oct. 14, 2016, Extended European Search Report issued by the European Patent Office in the corresponding European Patent Application No. 13868257.0.

(Continued)

*Primary Examiner* — Cephia D Toomer
(74) *Attorney, Agent, or Firm* — Kenja IP Law PC

(57) ABSTRACT

The disclosure provides (i) a lubricating oil composition including a base oil (A) with a kinematic viscosity at 100° C. of 8.2-12.6 $mm^2/s$ and a saturated hydrocarbon content of 90% by mass or more, a metallic detergent (B) and a zinc dithiophosphate (C), wherein a content of the metallic detergent (B) is 2.5 mmol or more as a soap content concentration per 100 g of the composition, a phosphorous content is 200-1000 mass ppm, and a base number is 7.5 mg KOH/g or more, and (ii) a lubricating oil composition including the base oil (A), the metallic detergent (B), the zinc dithiophosphate (C) and an amine-based antioxidant (E), wherein a content of the amine-based antioxidant (E) is 0.3% by mass or more in terms of total content of the composition, a base number is 6.5 mg KOH/g or more, and a phosphorous content is 200-1000 mass ppm.

7 Claims, No Drawings

(56) References Cited

FOREIGN PATENT DOCUMENTS

JP 2011-074387 A 4/2011

OTHER PUBLICATIONS

Chevron: "Chevron Group II/II + Typical Properties API Base Oil Category", Chevronbaseoils.com, Apr. 1, 2016, pp. 1-1, XP055272833, Retrieved from the Internet: http://www.chveronbaseoils.com/content/dam/chevron_base_oil/Products/CVXTypicals_US_4_16.pdf [retrieved on May 17, 2016].

Jul. 25, 2016, Partial Supplementary European Search Report issued by the European Patent Office in the corresponding European Patent Application No. 13868257.0.

Jun. 21, 2017, Communication pursuant to Article 94(3) EPC issued by the European Patent Office in the corresponding European Patent Application No. 13868257.0.

Dec. 19, 2017, Communication pursuant to Article 94(3) EPC issued by the European Patent Office in the corresponding European Patent Application No. 13868257.0.

* cited by examiner

SYSTEM LUBRICATING OIL COMPOSITION FOR CROSSHEAD DIESEL ENGINE

TECHNICAL FIELD

This disclosure relates to a system lubricating oil composition for crosshead diesel engines.

BACKGROUND

Cylinder oil for lubricating between the cylinder and piston and system oil responsible for lubricating and cooling other parts are used in crosshead diesel engines (see Patent Literatures (PTL) 1 to 6 listed below). System oil for crosshead diesel engines for ships is provided to the piston undercrown to cool the piston, yet since the piston undercrown is at a high temperature, heat exchange efficiency lowers if sludge or the like accumulates, and damage occurs to the piston due to heat (piston fracture). System oil for crosshead diesel engines for ships does not come into direct contact with combustion gas in the combustion chamber unlike other engine oils, and so can be regarded as a kind of hydraulic oil. If drips of the cylinder oil mix into and contaminate the system oil, thermal stability worsens, which makes coking occur more easily and may lead to sludge accumulating on the piston cooling surface. Therefore, high temperature detergency and an anti-coking property are important in system oil for crosshead diesel engines.

The base oils used in conventional lubricating oil are mainly manufactured by separating gasoline or a gas oil component from crude oil by distillation, further subjecting the resulting atmospheric distillation residue to reduced-pressure distillation, bringing out the necessary viscosity fraction, and refining the result. These base oils are classified in group I under the API base oil categorization.

Since the sulfur content and the aromatic content included in the base oil adversely affect the oxidation stability of the base oil, the above-mentioned residue has in recent years started to be subjected to hydrocracking to manufacture a base oil with an extremely small sulfur content and aromatic content. Wax manufactured by the Fischer-Tropsch process, petroleum-based wax which is a by-product when manufacturing base oil, or the like, is also subjected to hydrocracking to manufacture base oils with an extremely high viscosity index. These base oils manufactured by hydrocracking are classified in group II or III under the API base oil categorization.

During the refining process of the former base oils (group I), many processes are used to employ a solvent such as furfural, phenol, methylpyrrolidone, or the like to selectively extract and remove unstable compounds centering on the aromatic content. By contrast, in the manufacturing method of the latter base oils, the aromatic content in the base oils is extremely low, and there is nearly no need to undergo the above-described solvent refining processes. Therefore, the relative amount of base oil manufactured by undergoing a solvent refining process (i.e. group I base oil) is declining.

CITATION LIST

Patent Literatures

PTL 1: JP 2007-231115 A
PTL 2: JP 2010-523733 A
PTL 3: JP 2002-275491 A
PTL 4: JP 2009-185293 A
PTL 5: JP 2010-519376 A
PTL 6: JP 2011-74387 A

SUMMARY

Technical Problem

In these circumstances, the inventor discovered that by using a base oil high in saturated hydrocarbon content such as a group II or group III base oil instead of a group I base oil as the base oil of a system oil for crosshead diesel engines, the anti-coking property (thermal stability) of the system oil degrades upon drips of the cylinder oil mixing into the system oil.

It could thus be helpful to provide a system lubricating oil for crosshead diesel engines that has excellent high temperature detergency and anti-coking properties (thermal stability) with little generation of deposits even when using a base oil high in saturated hydrocarbon content such as a group II or group III base oil.

Solution to Problem

As a result of intensive research to achieve the stated object, the inventor discovered that the above-mentioned problems can be resolved by (i) while using a base oil high in saturated hydrocarbon content, adding a metallic detergent and a zinc dithiophosphate with the metallic detergent content being a specific value or more as a soap content concentration or (ii) while using a base oil high in saturated hydrocarbon content, adding a metallic detergent, a zinc dithiophosphate, and an amine-based antioxidant with the amine-based antioxidant content being a specific value or more, thereby completing the disclosure.

A first system lubricating oil composition for a crosshead diesel engine according to the disclosure (hereafter also simply referred to as a first lubricating oil composition according to the disclosure) includes:

a base oil (A) with a kinematic viscosity at 100° C. of 8.2 $mm^2/s$ to 12.6 $mm^2/s$ and a saturated hydrocarbon content of 90% by mass or more;

a metallic detergent (B); and a zinc dithiophosphate (C), wherein a content of the metallic detergent (B) is 2.5 mmol or more as a soap content concentration per 100 g of the composition, a phosphorous content is 200 mass ppm to 1000 mass ppm, and a base number is 7.5 mg KOH/g or more.

In a preferred embodiment of the first system lubricating oil composition for a crosshead diesel engine according to the disclosure, the base oil (A) includes a group II base oil and/or a group III base oil.

In another preferred embodiment of the first system lubricating oil composition for a crosshead diesel engine according to the disclosure, the base number is 8.0 mg KOH/g or more.

The first system lubricating oil composition for a crosshead diesel engine according to the disclosure preferably includes Ca salicylate as the metallic detergent (B).

The first system lubricating oil composition for a crosshead diesel engine according to the disclosure preferably further includes an ashless dispersant (D) of 0.04% to 0.2% by mass as a nitrogen content in terms of total content of the composition.

A second system lubricating oil composition for a crosshead diesel engine according to the disclosure (hereafter also simply referred to as a second lubricating oil composition according to the disclosure) includes:

a base oil (A) with a kinematic viscosity at 100° C. of 8.2 $mm^2/s$ to 12.6 $mm^2/s$ and a saturated hydrocarbon content of 90% by mass or more;

a metallic detergent (B);

a zinc dithiophosphate (C); and an amine-based antioxidant (E), wherein a content of the amine-based antioxidant (E) is 0.3% by mass or more in terms of total content of the composition, a base number is 6.5 mg KOH/g or more, and a phosphorous content is 200 mass ppm to 1000 mass ppm.

In a preferred embodiment of the second system lubricating oil composition for a crosshead diesel engine according to the disclosure, the base oil (A) includes a group II base oil and/or a group III base oil.

The second system lubricating oil composition for a crosshead diesel engine according to the disclosure preferably further includes an oil-soluble molybdenum compound (F) of 0.005% to 0.06% by mass as a molybdenum content in terms of total content of the composition.

Advantageous Effect

According to the disclosure, it is possible to provide a system lubricating oil for crosshead diesel engines that has excellent high temperature detergency and anti-coking properties (thermal stability) with little generation of deposits even when using a base oil high in saturated hydrocarbon content such as a group II or group III base oil.

DETAILED DESCRIPTION

The disclosure is described in detail below. A base oil (A) in a system lubricating oil composition for crosshead diesel engines (hereafter also simply referred to as a lubricating oil composition) according to the disclosure has a kinematic viscosity at 100° C. of 8.2 $mm^2/s$ to 12.6 $mm^2/s$, and a saturated hydrocarbon content of 90% by mass or more.

The kinematic viscosity at 100° C. of the base oil (A) is in a range from 8.2 $mm^2/s$ to 12.6 $mm^2/s$, preferably in a range from 8.5 $mm^2/s$ to 12.6 $mm^2/s$, more preferably in a range from 10.0 $mm^2/s$ to 12.3 $mm^2/s$, and even more preferably in a range from 11.0 $mm^2/s$ to 12.0 $mm^2/s$. If the kinematic viscosity at 100° C. of the base oil (A) is less than 8.2 $mm^2/s$, there is a risk of lubricity deteriorating since the oil film formation is insufficient at the lubrication spot. If the kinematic viscosity at 100° C. of the base oil (A) exceeds 12.6 $mm^2/s$, there is a risk of a problem occurring in fluidity at low temperatures. Note that in this disclosure, the kinematic viscosity at 100° C. refers to the kinematic viscosity at 100° C. as prescribed by ASTM D-445.

The base oil (A) has a saturated hydrocarbon content of 90% by mass or more, and is preferably classified as group II or group III in accordance with base oil classification by the American Petroleum Institute (API). In the disclosure, the saturated hydrocarbon content denotes the value measured by ASTM D-2007.

The manufacturing method of the base oil (A) is not particularly limited, yet typically, the atmospheric residual oil yielded by subjecting crude oil to atmospheric distillation is subjected to desulfurization and hydrocracking, and then to fractional distillation to a set viscosity grade. Alternatively, the residual oil is subjected to solvent dewaxing or catalytic dewaxing, and as necessary, further subjected to solvent extraction and hydrogenated to yield the base oil.

The base oil (A) also includes the case of a petroleum-based wax isomerization lubricating base oil yielded by hydroisomerization of petroleum-based wax that is a by-product yielded during a dewaxing process in a process for manufacturing base oil performed in recent years, whereby the atmospheric distillation residual oil is further subjected to reduced-pressure distillation and to fractional distillation to the necessary viscosity grade, and then after undergoing processes such as solvent refining, hydrorefining, and the like, the result is subjected to solvent dewaxing. Additionally, the base oil (A) includes the case of a GTL-based wax isomerization lubricating base oil manufactured by a method to isomerize GTL WAX (gas-to-liquid wax) manufactured by a process such as the Fischer-Tropsch process, and the like. The method of manufacturing the wax isomerization lubricating base oil in this case has the same basic manufacturing process as the manufacturing process for hydrocracked base oil.

The total aromatic content of the base oil (A) is not particularly limited, yet the total aromatic content is 3% by mass or less in one embodiment, 1% by mass or less in another embodiment, and 0.5% by mass or less in yet another embodiment. As the total aromatic content of the base oil (A) is smaller, i.e. as aromaticity is lower, the problem of solubility of sludge occurs more easily. Note that the total aromatic content denotes the aromatic fraction content measured in conformity with ASTM D2549.

The sulfur content of the base oil (A) is not particularly limited, yet the sulfur content is 0.03% by mass or less in one embodiment and 0.01% by mass or less in another embodiment, and in yet another embodiment, the base oil (A) substantially does not include sulfur. A lower sulfur content means a higher degree of refinement, making the problem of solubility of sludge occur more easily.

The base oil (A) of the lubricating oil composition according to the disclosure has a viscosity index of preferably 80 or more, more preferably 85 or more, and particularly preferably 90 or more. If the viscosity index of the base oil is less than 80, the viscosity at low temperatures rises, which may cause start-up performance to worsen. Note that in this disclosure, the viscosity index denotes the viscosity index measured in conformity with JIS K2283-1993.

The system lubricating oil composition for crosshead diesel engines according to the disclosure includes a metallic detergent (B) as an essential component.

Any compound normally used in lubricating oil can be used as the metallic detergent (B). Examples include sulfonate detergents, phenate detergents, and salicylate detergents. Among these, salicylate detergents are preferable, with a Ca salt salicylate detergent (i.e. Ca salicylate) being particularly preferable. In the case where the lubricating oil composition includes Ca salicylate, the water separation property is excellent, which significantly improves the hydrolysis stability of the lubricating oil composition. A single type of the above-mentioned metallic detergents may be used, or two or more types may be used in combination.

Examples of a sulfonate detergent that can be used include an alkaline earth metal salt of alkyl aromatic sulfonic acid, or an (overbased) basic salt thereof, obtained by sulfonation of an alkyl aromatic compound with a weight-average molecular weight of 400 to 1500, preferably 700 to 1300. Examples of the alkaline earth metal include magnesium, barium, and calcium. Magnesium and calcium are preferable, with calcium being particularly preferable. Examples of the alkyl aromatic sulfonic acid include so-called petroleum sulfonic acid and synthetic sulfonic acid. Examples of the petroleum sulfonic acid referred to here generally include the result of sulfonating an alkyl aromatic compound of lubricating oil distillate in mineral oil, as well as so-called mahogany acid, which is a by-product when manufacturing white oil. The synthetic sulfonic acid may, for example, be the result of sulfonating an alkylbenzene having a straight-chain or branched alkyl group obtained as a by-product from a plant for producing alkylbenzene used as the raw material for a detergent or obtained by an alkylation of a polyolefin in benzene, or the result of sulfonating an alkyl naphthalene, such as dinonylnaphthalene. The sulfonating agent when sulfonating these alkyl aromatic compounds is not particularly limited, yet typically fuming sulfuric acid or sulfuric anhydride is used.

As a phenate detergent, an alkylphenol sulfide alkaline earth metal salt or an (overbased) basic salt thereof having the structure shown in the following formula (1) may be used. Examples of the alkaline earth metal include magnesium, barium, and calcium. Magnesium and calcium are preferable, with calcium being particularly preferable.

(1)

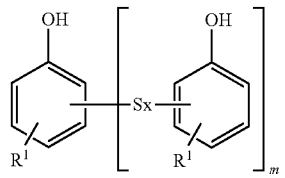

In the formula (1), $R^1$ represents a straight-chain or branched, saturated or unsaturated alkyl group or alkenyl group with a carbon number of 6 to 21, m represents the degree of polymerization and is an integer from 1 to 10, S represents elemental sulfur, and x represents an integer from 1 to 3.

The carbon number of the alkyl group or alkenyl group in the formula (1) is preferably from 9 to 18 and more preferably from 9 to 15. When the carbon number is less than 6, the solubility in the base oil may decrease, whereas when the carbon number exceeds 21, production becomes difficult, and thermal stability may worsen.

The phenate metal detergent preferably includes an alkylphenol sulfide metal salt for which the degree of polymerization m in the formula (1) is 1 to 4, since the resulting thermal stability is excellent.

As the salicylate detergent, the metal salicylate represented by the following formula (2) and/or an (overbased) basic salt thereof are preferable.

(2)

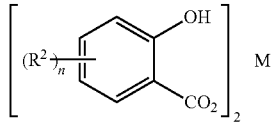

In the formula (2), $R^2$ each individually represent an alkyl group or alkenyl group, M represents an alkaline earth metal, preferably calcium or magnesium, with calcium being particularly preferable, and n is 1 or 2.

As the salicylate detergent, an alkaline earth metal salicylate, and/or an (overbased) basic salt thereof, containing one alkyl group or alkenyl group in the molecule is preferable.

The method of manufacturing the alkaline earth metal salicylate is not particularly limited, yet for example a well-known method of manufacturing monoalkyl salicylate may be used. The alkaline earth metal salicylate may, for example, be obtained by causing a metallic base, such as an alkaline earth metal oxide, hydroxide, or the like, to react with a monoalkyl salicylic acid obtained by subjecting a starting material of phenol to alkylation using an olefin and then to carboxylation using carbon dioxide gas or the like, or with a monoalkyl salicylic acid obtained by subjecting a starting material of salicylic acid to alkylation using an equivalent amount of the above-mentioned olefin, or by forming an alkali metal salt such as sodium salt, potassium salt, or the like, and then substituting with an alkaline earth metal salt.

The salicylate detergent includes not only the neutral salts obtained as described above, but also basic salts obtained by heating, in the presence of water, these neutral salts and excess alkaline earth metal salt or alkaline earth metal base (alkaline earth metal hydroxide or oxide), and overbased salts obtained by causing a neutral salt to react, in the presence of carbon dioxide gas, boric acid, or borate salt, with a base such as alkaline earth metal hydroxide.

In the lubricating oil composition according to the disclosure, a single metallic detergent (B) may be used, or two or more types may be used in combination. When used in combination, one of the following combinations is particularly preferable: (1) overbased Ca phenate/neutral Ca sulfonate, (2) overbased Ca phenate/overbased Ca salicylate, and (3) overbased Ca phenate/neutral Ca sulfonate/overbased Ca salicylate.

The first lubricating oil composition according to the disclosure includes the metallic detergent (B) of 2.5 mmol or more, preferably 2.55 mmol or more, and more preferably 2.6 mmol or more, and preferably 15.0 mmol or less, more preferably 8.0 mmol or less, and even more preferably 6.0 mmol or less, as a soap content concentration per 100 g of the composition. If the content of the metallic detergent (B) in the first lubricating oil composition according to the disclosure is less than 2.5 mmol/100 g as a soap content concentration, the high temperature detergency and anti-coking properties (thermal stability) of the lubricating oil composition cannot be improved sufficiently.

In this disclosure, the soap content concentration of the metallic detergent (B) is calculated according to the following equation.

The soap content concentration (mmol/100 g) of the metallic detergent=10×Σ[(the metallic detergent content (% by mass)×the metallic content (% by mass) in the metallic detergent)/(the metal ratio×the metal atomic mass)].

The metal ratio in the foregoing equation is calculated according to the following equation.

The metal ratio=the mass ratio of the total metallic element/the metallic element deriving from the soap molecule.

Examples of the soap molecule include sulfonic acids and derivatives thereof, phenols and derivatives thereof, and salicylic acids and derivatives thereof.

The content by percentage of the metallic detergent (B) in the lubricating oil composition according to the disclosure is, in terms of total content of the composition, preferably 1.5% to 31% by mass, more preferably 2.0% to 25% by mass, and particularly preferably 3.0% to 8.0% by mass. When the content by percentage of the metallic detergent (B) is less than 1.5% by mass, the necessary detergency and acid neutralization characteristics might not be obtained, whereas when exceeding 30% by mass, the metallic detergent (B) might emulsify in a centrifugal purifier.

The content by percentage of the metallic element based on the metallic detergent (B) component in the lubricating oil composition according to the disclosure is, in terms of total content of the composition, preferably 0.14% to 0.72% by mass, more preferably 0.17% to 0.54% by mass, and particularly preferably 0.21% to 0.36% by mass. When the content by percentage of the metallic element based on the metallic detergent (B) is less than 0.14% by mass, the necessary detergency and acid neutralization characteristics might not be obtained, whereas when exceeding 0.72% by mass, the excess metallic element becomes coarse and may form sludge in a centrifugal purifier.

The base number of the metallic detergent (B) is preferably in a range from 50 mg KOH/g to 500 mg KOH/g, with a range from 100 mg KOH/g to 450 mg KOH/g being more preferable, and a range from 120 mg KOH/g to 400 mg KOH/g being even more preferable. When the base number is less than 50 mg KOH/g, corrosion and wear may greatly increase, whereas when exceeding 500 mg KOH/g, problems may occur with solubility.

The metal ratio of the metallic detergent (B) is not particularly limited, yet it is preferable to use a metallic detergent (B) having a metal ratio with a lower limit of preferably 1 or more, more preferably 1.3 or more, and particularly preferably 2.0 or more, and an upper limit of preferably 5.0 or less, more preferably 4.0 or less, and particularly preferably 3.0 or less.

The system lubricating oil composition for crosshead diesel engines according to the disclosure includes a zinc dithiophosphate (C) (ZnDTP) as an essential component.

The zinc dithiophosphate (C) is preferably a compound represented by the following formula (3).

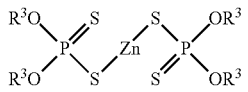

(3)

In the formula (3), $R^3$ each individually represent a hydrocarbon group having 1 to 24 carbon atoms. Each hydrocarbon group having 1 to 24 carbon atoms is preferably a straight-chain or branched alkyl group having 1 to 24 carbon atoms. The hydrocarbon groups preferably have a carbon number of 3 or more and preferably have a carbon number of 12 or less, more preferably 8 or less. The alkyl groups may be primary, secondary or tertiary, yet primary alkyl groups, secondary alkyl groups, and a mixture thereof are preferable, with primary alkyl groups being most preferable.

Examples of the zinc dithiophosphate (ZnDTP) include: zinc dialkyldithiophosphate that includes a straight-chain or branched (primary, secondary, or tertiary, with primary or secondary being preferable) alkyl group with a carbon number of 3 to 18, preferably 3 to 10, such as dipropyl zinc dithiophosphate, dibutyl zinc dithiophosphate, dipentyl zinc dithiophosphate, dihexyl zinc dithiophosphate, diheptyl zinc dithiophosphate, or dioctyl zinc dithiophosphate; di((alkyl) aryl) zinc dithiophosphate having an aryl group or alkylaryl group with a carbon number of 6 to 18, preferably 6 to 10, such as diphenyl zinc dithiophosphate or ditolyl zinc dithiophosphate; and a mixture of two or more of these.

The method of manufacturing the zinc dithiophosphate is not particularly limited, yet examples include synthesis by causing alcohol having an alkyl group corresponding to the above-mentioned $R^3$ to react with diphosphorus pentasulfide to synthesize dithiophosphate and then neutralizing the dithiophosphate with zinc oxide.

The content by percentage of the zinc dithiophosphate (C) in the lubricating oil composition according to the disclosure is, in terms of total content of the composition, preferably 0.25% to 1.4% by mass, more preferably 0.4% to 1.0% by mass, and particularly preferably 0.5% to 0.7% by mass. The zinc dithiophosphate (C) is preferably added so that the phosphorus content of the composition becomes 200 mass ppm to 1000 mass ppm, more preferably 300 mass ppm or more, even more preferably 350 mass ppm or more, and particularly preferably 400 mass ppm or more, and more preferably 800 mass ppm or less, even more preferably 700 mass ppm or less, and particularly preferably 600 mass ppm or less. When the phosphorus content deriving from the zinc dithiophosphate (C) is 200 mass ppm or more, the necessary gear performance is ensured. When the phosphorus content is 1000 mass ppm or less, a decrease in base number due to hydrolysis can be avoided.

The system lubricating oil composition for crosshead diesel engines according to the disclosure, especially the first lubricating oil composition according to the disclosure, preferably includes an ashless dispersant (D) in addition to the above-mentioned structural components.

Any ashless dispersant used in lubricating oil may be used as the ashless dispersant (D). Examples include a nitrogen-containing compound or a derivative thereof having in the molecule at least one straight-chain or branched alkyl group or alkenyl group with a carbon number of 40 to 400 and preferably 60 to 350, a Mannich dispersant, and a modified alkenyl succinimide. Upon use, any single type, or two or more types, selected from these may be blended.

When the carbon number of the alkyl group or alkenyl group in the nitrogen-containing compound or the derivative thereof is less than 40, the solubility in the lubricating base oil may decrease. When the carbon number exceeds 400, the low-temperature fluidity of the lubricating oil composition according to the disclosure may deteriorate. The alkyl group or alkenyl group may be straight-chain or branched. Preferable examples include a branched alkyl group and branched alkenyl group derived from an oligomer of an olefin such as propylene, 1-butene, or isobutylene or a co-oligomer of ethylene and propylene.

The ashless dispersant (D) is, for example, one type or two or more types of compounds selected from the following components (D-1) to (D-3).

(D-1) A succinimide or a derivative thereof having in the molecule at least one alkyl group or alkenyl group with a carbon number of 40 to 400.

(D-2) A benzylamine or a derivative thereof having in the molecule at least one alkyl group or alkenyl group with a carbon number of 40 to 400.

(D-3) A polyamine or a derivative thereof having in the molecule at least one alkyl group or alkenyl group with a carbon number of 40 to 400.

An example of the component (D-1) is a compound represented by the following formula (4) or (5).

(4)

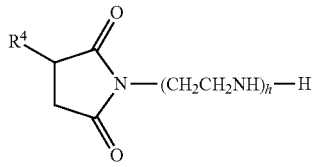

(5)

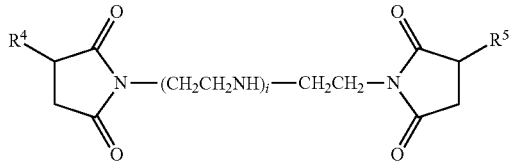

In the formula (4), $R^4$ represents an alkyl group or alkenyl group with a carbon number of 40 to 400 and preferably 60 to 350, and h represents an integer from 1 to 5 and preferably from 2 to 4.

In the formula (5), $R^5$ each individually represent an alkyl group or alkenyl group with a carbon number of 40 to 400 and preferably 60 to 350, with a polybutenyl group being particularly preferable, and i represents an integer from 0 to 4 and preferably from 1 to 3.

The component (D-1) includes a mono-type succinimide represented by the formula (4) in which succinic anhydride is added to one end of polyamine, and a bis-type succinimide represented by the formula (5) in which succinic anhydride is added to both ends of polyamine. The composition according to the disclosure may include any of these or a mixture thereof.

The method of manufacturing the succinimide which is the component (D-1) is not particularly limited. For example, the succinimide is obtained by causing a compound having an alkyl group or alkenyl group with a carbon number of 40 to 400 to react with maleic anhydride at 100° C. to 200° C. and then causing the resulting alkyl succinic acid or alkenyl succinic acid to react with a polyamine. Examples of the polyamine include diethylenetriamine, triethylenetetramine, tetraethylenepentamine, and pentaethylenehexamine.

An example of the component (D-2) is a compound represented by the following formula (6).

(6)

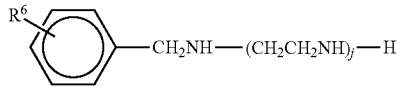

In the formula (6), $R^6$ represents an alkyl group or alkenyl group with a carbon number of 40 to 400 and preferably 60 to 350, and j represents an integer from 1 to 5 and preferably from 2 to 4.

The method of manufacturing the benzylamine which is the component (D-2) is not particularly limited. For example, a method of causing a polyolefin such as a propylene oligomer, a polybutene, or an ethylene-α-olefin copolymer to react with phenol to form alkylphenol and then causing this to react with formaldehyde and a polyamine such as diethylenetriamine, triethylenetetramine, tetraethylenepentamine, or pentaethylenehexamine by Mannich reaction may be used.

An example of the component (D-3) is a compound represented by the following formula (7).

$$R^7—NH—(CH_2CH_2NH)_k—H \quad (7)$$

In the formula (7), $R^7$ represents an alkyl group or alkenyl group with a carbon number of 40 to 400 and preferably 60 to 350, and k represents an integer from 1 to 5 and preferably from 2 to 4.

The method of manufacturing the polyamine which is the component (D-3) is not particularly limited. For example, a method of chlorinating a polyolefin such as a propylene oligomer, a polybutene, or an ethylene-α-olefin copolymer and then causing this to react with ammonia or a polyamine such as ethylenediamine, diethylenetriamine, triethylenetetramine, tetraethylenepentamine, or pentaethylenehexamine may be used.

Examples of the derivative of the nitrogen-containing compound as an example of the ashless dispersant (D) include: a modified compound by an oxygen-containing organic compound, which is obtained by causing a monocarboxylic acid with a carbon number of 1 to 30 such as a fatty acid, a polycarboxylic acid with a carbon number of 2 to 30 such as oxalic acid, phthalic acid, trimellitic acid, or pyromellitic acid, an anhydride thereof, an ester compound, an alkylene oxide with a carbon number of 2 to 6, or hydroxy(poly)oxyalkylenecarbonate to act on the above-mentioned nitrogen-containing compound to neutralize or amidate a part or all of the remaining amino group and/or imino group; a boron modified compound obtained by causing a boric acid to act on the above-mentioned nitrogen-containing compound to neutralize or amidate a part or all of the remaining amino group and/or imino group; a phosphate modified compound obtained by causing a phosphoric acid to act on the above-mentioned nitrogen-containing compound to neutralize or amidate a part or all of the remaining amino group and/or imino group; a sulfur modified compound obtained by causing a sulfur compound to act on the above-mentioned nitrogen-containing compound; and a modified compound obtained by subjecting the above-mentioned nitrogen-containing compound to a combination of two or more types of modification selected from the modification by an oxygen-containing organic compound, the boron modification, the phosphate modification, and the sulfur modification. Among these derivatives, a borate modified compound of alkenyl succinimide, especially a borate modified compound of alkenyl succinimide of bis-type, can further improve the thermal stability of the lubricating oil composition.

The content by percentage of the ashless dispersant (D) in the lubricating oil composition according to the disclosure is, as a nitrogen content in terms of total content of the composition, preferably 0.04% by mass or more and more preferably 0.07% by mass or more, and preferably 0.2% by mass or less. When the content by percentage of the ashless dispersant (D) exceeds 0.2% by mass as a nitrogen content in terms of total content of the composition, the separation of contaminants may degrade and emulsification may occur in a centrifugal purifier. When the content by percentage of the ashless dispersant (D) is 0.04% by mass or more as a nitrogen content in terms of total content of the composition, the anti-coking properties (thermal stability) of the lubricating oil composition can be improved sufficiently.

The second system lubricating oil composition for crosshead diesel engines according to the disclosure includes an amine-based antioxidant (E) as an essential component.

Examples of the amine-based antioxidant include a diphenylamine derivative and a phenyl-α-naphthylamine derivative. A compound represented by the following formula (8) and a compound represented by the following formula (9) are preferable. Any single type, or a mixture of two or more types, selected from these may be used.

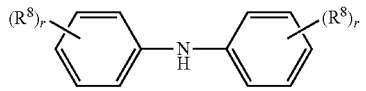

(8)

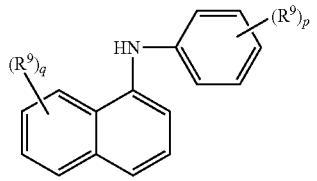

(9)

The compound of the formula (8) is typically obtained by causing the reaction of N-phenylbenzenamine and an alkene. In the formula (8), $R^8$ each individually represent hydrogen or a hydrocarbon group, and r each individually represent an integer from 0 to 5. In the case where a plurality of $R^8$ are present, each $R^8$ may be the same or different. The carbon number of the hydrocarbon group is preferably 1 to 12, and particularly preferably 1 to 9. As the hydrocarbon group, an alkyl group is particularly preferable.

In the formula (9), $R^9$ each individually represent a hydrocarbon group with a carbon number of 1 to 20 and preferably 3 to 20, p represents an integer from 0 to 5, and q represents an integer from 0 to 7, where at least one of p and q is not 0. In the case where a plurality of $R^9$ are present, each $R^9$ may be the same or different. As $R^9$, a straight-chain or branched octyl group or nonyl group is particularly preferable, and one of a naphthyl group and a phenyl group substituted by one $R^9$ is particularly preferable.

Specific examples of the amine-based antioxidant include N-phenyl-1,1,3,3-tetramethylbutylnaphthalene-1-amine, a reaction product of N-phenylbenzenamine and 2,4,4-trimethylpentene, p,p'-dioctyldiphenylamine, N-phenyl-N'-isopropyl-p-phenylenediamine, poly-2,2,4-trimethyl-1,2-dihydroquinoline, 6-ethoxy-2,2,4-trimethyl-1,2-dihydroquinoline, thiodiphenylamine, and 4-amino-p-diphenylamine.

The content by percentage of the amine-based antioxidant (E) in the second lubricating oil composition according to the disclosure is, in terms of total content of the composition, 0.3% by mass or more, preferably 0.4% by mass or more, and more preferably 0.5% by mass or more, and preferably 3% by mass or less, and more preferably 2.5% by mass or less. When the content of the amine-based antioxidant (E) in the second lubricating oil composition according to the disclosure is less than 0.3% by mass in terms of total content of the composition, the anti-coking properties (thermal stability) of the lubricating oil composition cannot be improved sufficiently. An excessively high content of the amine-based antioxidant (E) may degrade the anti-coking properties (thermal stability) of the lubricating oil composition. When the content of the amine-based antioxidant (E) is 3% by mass or less in terms of total content of the composition, such degradation of the anti-coking properties (thermal stability) of the lubricating oil composition can be avoided.

The system lubricating oil composition for crosshead diesel engines according to the disclosure, especially the second lubricating oil composition according to the disclosure, preferably includes an oil-soluble molybdenum compound (F) in addition to the above-mentioned structural components.

Examples of the oil-soluble molybdenum compound (F) include: an organic molybdenum compound including sulfur, such as molybdenum dithiophosphate (MoDTP) or molybdenum dithiocarbamate (MoDTC); a complex of a molybdenum compound (e.g. a molybdenum oxide such as molybdenum dioxide or molybdenum trioxide, a molybdic acid such as orthomolybdic acid, paramolybdic acid, or molybdic acid (poly)sulfide, a metal salt of the molybdic acid, a molybdate such as ammonium salt, a molybdenum sulfide such as molybdenum disulfide, molybdenum trisulfide, molybdenum pentasulfide, or molybdenum polysulfide, a molybdic acid sulfide, a metal salt or amine salt of the molybdic acid sulfide, a molybdenum halide such as molybdenum chloride, etc.) and a sulfur-containing organic compound (e.g. alkyl(thio)xanthate, thiadiazole, mercapto thiadiazole, thiocarbonate, tetrahydrocarbylthiuram disulfide, bis(di(thio)hydrocarbyldithiophosphonate) disulfide, organic (poly)sulfide, sulfide ester, etc.) or other organic compound; and a complex of a sulfur-containing molybdenum compound such as molybdenum sulfide or molybdic acid sulfide mentioned above and an alkenyl succinimide. In the above-mentioned molybdenum dithiocarbamate, the alkyl group may be straight-chain or branched, and the alkyl group linkage of the alkylphenyl group may be at any position. A mixture of these is also applicable. As the molybdenum dithiocarbamate, a compound having hydrocarbon groups different in carbon number and/or structure in one molecule may be preferably used, too.

As the molybdenum dithiophosphate (MoDTP), a compound represented by the following formula (10) is preferable.

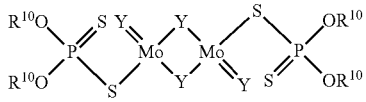

(10)

In the formula (10), $R^{10}$ each individually represent a straight-chain or branched alkyl group or alkenyl group with a carbon number of 4 to 18, and Y each individually represent an oxygen atom or a sulfur atom, where the ratio of the oxygen atom and the sulfur atom is 1/3 to 3/1. $R^{10}$ is preferably an alkyl group, and particularly preferably a branched alkyl group with a carbon number of 8 to 14. Specific examples of $R^{10}$ include butyl group, 2-ethylhexyl group, isotridecyl group, and stearyl group. The four $R^{10}$ present in one molecule may be the same or different. A mixture of two or more types of MoDTP with different $R^{10}$ may be used in the lubricating oil composition according to the disclosure.

As the molybdenum dithiocarbamate (MoDTC), a compound represented by the following formula (11) is preferable.

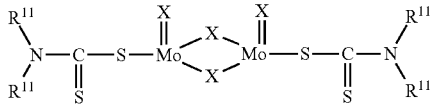

(11)

In the formula (11), $R^{11}$ each individually represent a straight-chain or branched alkyl group or alkenyl group with a carbon number of 4 to 18, and X each individually represent an oxygen atom or a sulfur atom, where the ratio of the oxygen atom and the sulfur atom is 1/3 to 3/1. $R^{11}$ is preferably an alkyl group, and particularly preferably a branched alkyl group with a carbon number of 8 to 14. Specific examples of $R^{11}$ include butyl group, 2-ethylhexyl group, isotridecyl group, and stearyl group. The four $R^{11}$ present in one molecule may be the same or different. A mixture of two or more types of MoDTC with different $R^{11}$ may be used in the lubricating oil composition according to the disclosure.

As the oil-soluble molybdenum compound (F), an oil-soluble molybdenum compound not including sulfur as a structural element may be used. Specific examples of an organic molybdenum compound not including sulfur as a structural element include a molybdenum-amine complex and a molybdenum-succinimide complex.

The molybdenum compound forming the molybdenum-amine complex includes a molybdenum compound not including sulfur, such as molybdenum trioxide or a hydrate thereof ($MoO_3.nH_2O$), molybdic acid ($H_2MoO_4$), alkali metal salt of molybdic acid ($M_2MoO_4$: M represents the alkali metal), ammonium molybdic acid ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, or $Mo_2O_3Cl_6$. Among these molybdenum compounds, hexavalent molybdenum compounds are preferable from the perspective of the yield of the molybdenum-amine complex. Among the hexavalent molybdenum compounds, molybdenum trioxide or a hydrate thereof, molybdic acid, alkali metal salt of molybdic acid, and ammonium molybdic acid are preferable from the perspective of availability.

The amine compound forming the molybdenum-amine complex is not particularly limited, yet specific examples as a nitrogen compound include a monoamine, a diamine, a polyamine, and an alkanolamine. More specific examples include: an alkylamine having an alkyl group (such alkyl group may be straight-chain or branched) with a carbon number of 1 to 30; an alkenylamine having an alkenyl group (such alkenyl group may be straight-chain or branched) with a carbon number of 2 to 30; an alkanolamine having an alkanol group (such alkanol group may be straight-chain or branched) with a carbon number of 1 to 30; an alkylenediamine having an alkylene group with a carbon number of 1 to 30; a polyamine such as diethylenetriamine, triethylenetetramine, tetraethylenepentamine, or pentaethylenehexamine; a compound having an alkyl group or alkenyl group with a carbon number of 8 to 20 in the above-mentioned monoamine, diamine, or polyamine, or a heterocyclic compound such as imidazoline; an alkylene oxide adduct of these compounds; and a mixture thereof. Among these amine compounds, a primary amine, a secondary amine, and an alkanolamine are preferable.

The carbon number of the hydrocarbon group in the amine compound forming the molybdenum-amine complex is preferably 4 or more, more preferably 4 to 30, and particularly preferably 8 to 18. When the carbon number of the hydrocarbon group in the amine compound is less than 4, the solubility tends to decrease. Moreover, by setting the carbon number of the amine compound to 30 or less, the molybdenum content in the molybdenum-amine complex can be increased relatively. This allows a small blending quantity to enhance the advantageous effects of the disclosure.

The molybdenum-succinimide complex may be a complex of a molybdenum compound not including sulfur, such as the examples given in the above description of the molybdenum-amine complex, and a succinimide having an alkyl group or alkenyl group with a carbon number of 4 or more. Examples of the succinimide include a succinimide or a derivative thereof having in the molecule at least one alkyl group or alkenyl group with a carbon number of 40 to 400 as described with regard to the ashless dispersant, and a succinimide having an alkyl group or alkenyl group with a carbon number of 4 to 39 and preferably 8 to 18. When the carbon number of the alkyl group or alkenyl group in the succinimide is less than 4, the solubility tends to decrease. Although a succinimide having an alkyl group or alkenyl group with a carbon number of more than 30 and not more than 400 may be used, by setting the carbon number of the alkyl group or alkenyl group to 30 or less, the molybdenum content in the molybdenum-succinimide complex can be increased relatively. This allows a small blending quantity to enhance the advantageous effects of the disclosure.

The content by percentage of the oil-soluble molybdenum compound (F) in the lubricating oil composition according to the disclosure is, as a molybdenum content in terms of total content of the composition, preferably 0.005% by mass or more, and more preferably 0.01% by mass or more, and preferably 0.06% by mass or less, more preferably 0.04% by mass or less, and particularly preferably 0.03% by mass or less. When the content of the oil-soluble molybdenum compound (F) is 0.005% by mass or more as a molybdenum content in terms of total content of the composition, the anti-coking properties (thermal stability) of the lubricating oil composition can be improved significantly. An excessively high content of the oil-soluble molybdenum compound (F) may degrade the anti-coking properties (thermal stability) of the lubricating oil composition. When the content of the oil-soluble molybdenum compound (F) is 0.06% by mass or less as a molybdenum content in terms of total content of the composition, such degradation of the anti-coking properties (thermal stability) of the lubricating oil composition can be avoided.

In order to further improve the properties of the lubricating oil composition or to add other required properties, the lubricating oil composition according to the disclosure may further include any additive that is typically used in lubricating oil according to the purpose. Examples of such an additive in the first lubricating oil composition according to the disclosure include an antioxidant, an anti-foaming agent, a pour point depressant, a metal deactivator, and an extreme pressure agent. Examples of such an additive in the second lubricating oil composition according to the disclosure include an antioxidant other than the amine-based antioxidant, an anti-foaming agent, a pour point depressant, a metal deactivator, and an extreme pressure agent.

Examples of the antioxidant in the first lubricating oil composition according to the disclosure include ashless antioxidants such as phenol-based antioxidants or amine-based antioxidants, or metallic antioxidants. Among these, phenol-based antioxidants and amine-based antioxidants are preferable from the perspective of maintaining high temperature detergency. When including an antioxidant in the first lubricating oil composition according to the disclosure, the content thereof in terms of total content of the composition is preferably 0.05% by mass or more, and more preferably 0.1% by mass or more. In the case of using an amine-based antioxidant, the content is particularly preferably 0.3% by mass or more. In the case of using a phenol-based antioxidant, the content is particularly preferably 0.15% by mass or more. The upper limit of the antioxidant content is not particularly limited, yet the antioxidant content in terms of total content of the composition is preferably 5% by mass or less, and more preferably 2% by mass or less.

Examples of the antioxidant other than the amine-based antioxidant in the second lubricating oil composition according to the disclosure include phenol-based antioxidants. When including a phenol-based antioxidant in the second lubricating oil composition according to the disclosure, the content thereof in terms of total content of the composition is preferably 0.05% by mass or more, more preferably 0.1% by mass or more, and particularly preferably 0.15% by mass or more, and preferably 2% by mass or less. When the content of the phenol-based antioxidant exceeds 2% by mass in terms of total content of the composition, the phenol-based antioxidant may not dissolve.

Examples of the anti-foaming agent include silicone oil, alkenylsuccinic acid derivatives, esters of polyhydroxy aliphatic alcohols and long-chain fatty acids, methylsalicylate, o-hydroxybenzyl alcohol, aluminum stearate, potassium oleate, N-dialkyl-allylamine nitroaminoalkanol, aromatic amine salts of isoamyloctyl phosphate, alkylalkylene diphosphates, metal derivatives of thioethers, metal derivatives of disulfides, fluorine compounds of aliphatic hydrocarbons, triethylsilane, dichlorosilane, alkylphenyl polyethylene glycol ether sulfide, and fluoroalkyl ethers. When including an anti-foaming agent in the lubricating oil composition according to the disclosure, the content thereof is, in terms of total content of the composition, normally selected from a range of 0.0005% to 1% by mass, and when the anti-foaming agent includes silicon, the anti-foaming agent is preferably added so that the Si component of the composition is 5 mass ppm to 50 mass ppm.

As the pour point depressant, it is possible to use for example a polymethacrylate-based polymer or the like conforming to the lubricating base oil being used. When including a pour point depressant in the lubricating oil composition according to the disclosure, the content thereof in terms of total content of the composition is normally selected from a range of 0.005% to 5% by mass.

Examples of the metal deactivator include imidazolines, pyrimidine derivatives, alkyl thiadiazoles, mercaptobenzothiazoles, benzotriazoles and derivatives thereof, 1,3,4-thiadiazole polysulfide, 1,3,4-thiadiazolyl-2,5-bisdialkyl dithiocarbamate, 2-(alkyldithio) benzoimidazole, and β-(o-carboxybenzylthio) propionitrile. When including a metal deactivator in the lubricating oil composition according to the disclosure, the content thereof in terms of total content of the composition is normally selected from a range of 0.005% to 1% by mass.

As the extreme pressure agent, for example, sulfur, phosphorous, and sulfur-phosphorous extreme pressure agents may be used. Examples include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metallic salts thereof, derivatives thereof, dithiocarbamate, zinc dithiocarbamate, molybdenum dithiocarbamate, disulfides, polysulfides, sulfurized olefins, sulfurized fats and oils, and the like. When using an extreme pressure agent in the lubricating oil composition according to the disclosure, the content thereof is not particularly limited, yet in terms of total content of the composition, the content is normally 0.01% to 5% by mass.

The system lubricating oil composition for crosshead diesel engines according to the disclosure has a phosphorus content of 200 mass ppm to 1000 mass ppm, preferably 300 mass ppm or more, more preferably 350 mass ppm or more, and even more preferably 400 mass ppm or more, and preferably 800 mass ppm or less, more preferably 700 mass ppm or less, and even more preferably 600 mass ppm or less. If the phosphorus content of the lubricating oil composition is less than 200 mass ppm, the gear performance during Power Take-Off (PTO) is insufficient, whereas if the phosphorus content exceeds 1000 mass ppm, the hydrolysis product of ZnDTP and the detergent react, eliminating the detergent, which may lower the maintainability of the base number.

The first system lubricating oil composition for crosshead diesel engines according to the disclosure needs to have the necessary base number for a system lubricating oil composition for crosshead diesel engines. Specifically, the base number is 7.5 mg KOH/g (perchloric acid method) or more, and preferably 8.0 mg KOH/g or more, and preferably 20 mg KOH/g or less, and more preferably 15 mg KOH/g or less. Regarding the first lubricating oil composition according to the disclosure, when the base number of the lubricating oil composition is less than 7.5 mg KOH/g, the thermal stability and the detergency are insufficient. When the base number of the lubricating oil composition exceeds 20 mg KOH/g, it becomes difficult to remove contaminants with a purifier. In this disclosure, the base number denotes the base number measured by a perchloric acid method in conformity with section 7 of JIS K2501, "Petroleum products and lubricants—Determination of neutralization number".

The second system lubricating oil composition for crosshead diesel engines according to the disclosure needs to have the necessary base number for a system lubricating oil composition for crosshead diesel engines. Specifically, the base number is 6.5 mg KOH/g (perchloric acid method) or more, and preferably 7.0 mg KOH/g or more, and preferably 20 mg KOH/g or less, and more preferably 15 mg KOH/g or less. Regarding the second lubricating oil composition according to the disclosure, when the base number of the lubricating oil composition is less than 6.5 mg KOH/g, the thermal stability and the detergency are insufficient. When the base number of the lubricating oil composition exceeds 20 mg KOH/g, it becomes difficult to remove contaminants with a purifier.

The system lubricating oil composition for crosshead diesel engines according to the disclosure needs to have the necessary kinematic viscosity for a system lubricating oil composition for crosshead diesel engines. The kinematic viscosity at 100° C. is preferably 8.2 $mm^2/s$ or more, and more preferably 9.3 $mm^2/s$ or more, and preferably less than 12.6 $mm^2/s$, and more preferably less than 12.0 $mm^2/s$. If the kinematic viscosity at 100° C. of the lubricating oil composition is less than 8.2 $mm^2/s$, the oil film forming ability may be insufficient, and the bearing may burn out, whereas if the kinematic viscosity at 100° C. is 12.6 $mm^2/s$ or more, cooling of the piston cooling surface may be insufficient, causing burnout of the piston, and start-up performance may worsen due to high viscosity.

Examples

The disclosure is described in more detail below by way of examples, yet the disclosure is not limited to these examples.

Reference Example a, Examples a1 to a11, Comparative Examples a1 to a6

Lubricating oil compositions with the formulations shown in Tables 1 and 2 were prepared, and a hot tube test in conformity with JPI-5S-55-99 and a hydrolysis test as a modification of ASTM D2619 were performed. Tables 1 and 2 list the results. Note that in Tables 1 and 2, the amount of the base oil is the content in terms of total content of the base oil, whereas the amount of the additives is the content in terms of total content of the composition.

<Hot Tube Test>

Using mixed oils with 90% by mass of each test oil and 10% by mass of cylinder oil drip oil, a hot tube test was performed at 270° C., 280° C., and 290° C. in conformity with JPI-5S-55-99, and assessment was performed by rating the depth of hue of the discolored portion in the test tube after the test (from 0 points (black) to 10 points (transparent=best)). A higher rating indicates better high temperature detergency. In Table 2, "obstructed" indicates that the glass tube was obstructed and that anti-coking properties were poor.

The cylinder oil drip oil that was used was collected from a crosshead diesel engine installed in a VLCC (Middle East—Japan), and the properties were a kinematic viscosity at 100° C. of 28.1 $mm^2/s$, an acid number of 7.5 mg KOH/g, a base number (perchloric acid method) of 24.1 mg KOH/g, and pentane insolubles (A method) of 6.0% by mass.

<Hydrolysis Test>

Each sample (100 g of oil under test/10 g of distilled water) was charged into a coke bottle, and stirred by rotating it at 5 rpm in a thermostat chamber of 93° C. After 24 hours, the sample was centrifuged for 1 hour at 40000 G to separate aqueous emulsion, and the base number of supernatant oil was measured. A higher base number indicates more excellent hydrolysis stability.

TABLE 1

| | | | Ref. Ex. a | Ex. a1 | Ex. a2 | Ex. a3 | Ex. a4 | Ex. a5 | Ex. a6 | Ex. a7 | Ex. a8 |
|---|---|---|---|---|---|---|---|---|---|---|---|
| Base oil | Mineral base oil 1 | % by mass | | 95 | 95.5 | | 91.5 | 92 | 91 | 92 | 91 |
| | Mineral base oil 2 | % by mass | | | | 92 | | | | | |
| | Mineral base oil 3 | % by mass | | 5 | | | 8.5 | 8 | 9 | 8 | 9 |
| | Mineral base oil 4 | % by mass | | | | 8 | | | | | |
| | Mineral base oil 5 | % by mass | 92 | | | | | | | | |
| | Mineral base oil 6 | % by mass | 8 | | 4.5 | | | | | | |
| Kinematic viscosity at 100° C. of base oil | | $mm^2/s$ | 11.7 | 11.2 | 11.2 | 11.2 | 11.6 | 11.55 | 11.7 | 11.55 | 11.7 |
| Saturated hydrocarbon content of base oil | | % by mass | 55.7 | 98.9 | 96.5 | 92.7 | 98.9 | 98.9 | 98.9 | 98.9 | 98.9 |
| Sulfur content of base oil | | % by mass | 0.61 | 0.00 | 0.02 | 0.00 | 0.00 | 0.00 | 0.00 | 0.00 | 0.00 |
| Additive | (B) Ca salicylate | % by mass | 3.8 | 4.1 | 4.1 | 4.1 | 5.1 | | 4.1 | | |
| | (B) Ca phenate | % by mass | | | | | | 5.1 | 0.6 | 4.3 | |
| | (B) Ca sulfonate 1 | % by mass | | | | | | | | | 2.65 |
| | (B) Ca sulfonate 2 | % by mass | | | | | | | | | 3.8 |
| | (C) ZnDTP | % by mass | 0.57 | 0.57 | 0.57 | 0.57 | 0.57 | 0.57 | 0.57 | 0.57 | 0.57 |
| | (D) Ashless dispersant | % by mass | | 4.0 | 4.0 | 4.0 | | | | | |
| Soap content concentration in composition | | mmol/100 g | 2.48 | 2.67 | 2.67 | 2.67 | 3.33 | 3.04 | 3.03 | 2.56 | 2.55 |
| Base number of composition (perchloric acid method) | | mgKOH/g | 6.5 | 8.5 | 8.5 | 8.5 | 8.7 | 13 | 8.5 | 11 | 9.3 |
| Ca content of composition | | % by mass | 0.23 | 0.245 | 0.245 | 0.245 | 0.305 | 0.47 | 0.32 | 0.4 | 0.426 |
| Phosphorus content of composition | | % by mass | 0.042 | 0.042 | 0.042 | 0.042 | 0.042 | 0.042 | 0.042 | 0.042 | 0.042 |
| Nitrogen content of composition | | % by mass | 0.00 | 0.07 | 0.07 | 0.07 | 0.00 | 0.00 | 0.00 | 0.00 | 0.00 |
| Kinematic viscosity at 100° C. of composition | | $mm^2/s$ | 11.5 | 11.5 | 11.5 | 11.5 | 11.5 | 11.5 | 11.5 | 11.5 | 11.5 |
| Hot tube test | Rating (270° C.) | | 5.0 | 8.5 | 8.5 | 8.5 | 9.0 | 8.0 | 8.5 | 7.5 | 7.5 |
| | Rating (280° C.) | | 3.5 | 1.0 | 1.0 | 1.0 | 4.0 | 7.5 | 3.5 | 3.0 | 3.5 |
| | Rating (290° C.) | | 0.5 | 0.0 | 0.5 | 0.0 | 1.5 | 3.0 | 0.0 | 0.5 | 1.0 |
| Hydrolysis test | Residual base number | mgKOH/g | 6.0 | 7.8 | 7.6 | 7.7 | 8.0 | 4.9 | 6.9 | 3.5 | 5.6 |

TABLE 2

| | | | Ex. a9 | Ex. a10 | Ex. a11 | Comp. Ex. a1 | Comp. Ex. a2 | Comp. Ex. a3 | Comp. Ex. a4 | Comp. Ex. a5 | Comp. Ex. a6 |
|---|---|---|---|---|---|---|---|---|---|---|---|
| Base oil | Mineral base oil 1 | % by mass | 91.5 | 91.5 | 90 | 92 | 92 | 92 | 94 | 91 | |
| | Mineral base oil 2 | % by mass | | | | | | | | | 97 |
| | Mineral base oil 3 | % by mass | 8.5 | 8.5 | 10 | | | | | 9 | |
| | Mineral base oil 4 | % by mass | | | | | | | | | 3 |
| | Mineral base oil 5 | % by mass | | | | | | | | | |
| | Mineral base oil 6 | % by mass | | | | 8 | 8 | 8 | 6 | | |
| Kinematic viscosity at 100° C. of base oil | | $mm^2/s$ | 11.6 | 11.6 | 10.8 | 11.7 | 11.7 | 11.7 | 11.4 | 11.7 | 11.7 |
| Saturated hydrocarbon content of base oil | | % by mass | 98.9 | 98.9 | 98.9 | 94.7 | 94.7 | 94.7 | 95.7 | 98.9 | 93.8 |
| Sulfur content of base oil | | % by mass | 0.00 | 0.00 | 0.00 | 0.04 | 0.04 | 0.04 | 0.03 | 0.00 | 0.00 |
| Additive | (B) Ca salicylate | % by mass | 5.1 | 5.1 | 4.1 | 3.2 | | | 3.8 | 3.8 | 3.8 |
| | (B) Ca phenate | % by mass | | | | | 2.55 | | | | |
| | (B) Ca sulfonate 1 | % by mass | | | | | | 2.05 | | | |
| | (B) Ca sulfonate 2 | % by mass | | | | | | | | | |
| | (C) ZnDTP | % by mass | 0.40 | 1.09 | 0.57 | 0.57 | 0.57 | 0.57 | 0.57 | 0.57 | 0.57 |
| | (D) Ashless dispersant | % by mass | | | 6.0 | | | | 2 | | |
| Soap content concentration in composition | | mmol/100 g | 3.33 | 3.33 | 2.67 | 2.09 | 1.52 | 0.60 | 2.48 | 2.48 | 2.48 |
| Base number of composition (perchloric acid method) | | mgKOH/g | 8.7 | 8.7 | 9.3 | 5.5 | 6.5 | 6.5 | 7.3 | 6.5 | 6.5 |
| Ca content of composition | | % by mass | 0.305 | 0.305 | 0.245 | 0.19 | 0.24 | 0.26 | 0.23 | 0.23 | 0.23 |
| Phosphorus content of composition | | % by mass | 0.030 | 0.080 | 0.042 | 0.042 | 0.042 | 0.042 | 0.042 | 0.042 | 0.042 |
| Nitrogen content of composition | | % by mass | 0.00 | 0.00 | 0.11 | 0.00 | 0.00 | 0.00 | 0.035 | 0.00 | 0.00 |
| Kinematic viscosity at 100° C. of composition | | $mm^2/s$ | 11.5 | 11.5 | 11.5 | 11.5 | 11.5 | 11.5 | 11.5 | 11.5 | 11.5 |
| Hot tube test | Rating (270° C.) | | 9.0 | 8.5 | 8.5 | 3.5 | 0.0 | 0.0 | 5.0 | 4.5 | 4.5 |
| | Rating (280° C.) | | 3.5 | 4.0 | 1.0 | 0.0 | obstructed | obstructed | 0.5 | 0.0 | 0.0 |
| | Rating (290° C.) | | 1.0 | 0.5 | 0.5 | obstructed | obstructed | obstructed | obstructed | obstructed | obstructed |
| Hydrolysis test | Residual base number | mgKOH/g | 8.4 | 7.2 | 8.4 | 5.1 | 2.1 | 3.9 | 5.6 | 5.8 | 5.7 |

Mineral base oil 1: group II base oil, 500 N, kinematic viscosity at 40° C.=93.9 $mm^2/s$, kinematic viscosity at 100° C.=10.7 $mm^2/s$, sulfur content=0.00% by mass, saturated hydrocarbon content=98.9% by mass, total aromatic content=0.9% by mass Mineral base oil 2: group II base oil, 500 N, kinematic viscosity at 40° C.=108 $mm^2/s$, kinematic viscosity at 100° C.=12.0 $mm^2/s$, sulfur content=0.00% by mass, saturated hydrocarbon content=94.5% by mass, total aromatic content=5.1% by mass Mineral base oil 3: group II base oil, 2050, kinematic viscosity at 40° C.=387 $mm^2/s$, kinematic viscosity at 100° C.=29.4 $mm^2/s$, sulfur content=0.00% by mass, saturated hydrocarbon content=99.1% by mass, total aromatic content=0.7% by mass Mineral base oil 4: group I base oil, 150 N, kinematic viscosity at 40° C.=30.6 $mm^2/s$, kinematic viscosity at 100° C.=5.25 $mm^2/s$, sulfur content=0.48% by mass, saturated hydrocarbon content=71.5% by mass, total aromatic content=28.0% by mass Mineral base oil 5: group I base oil, 500 N, kinematic viscosity at 40° C.=95.3 $mm^2/s$, kinematic viscosity at 100° C.=10.8 $mm^2/s$, sulfur content=0.62% by mass, saturated hydrocarbon content=56.5% by mass, total aromatic content=42.9% by mass Mineral base oil 6: group I base oil, 2600 (bright stock), kinematic viscosity at 40° C.=481 $mm^2/s$, kinematic viscosity at 100° C.=31.7 $mm^2/s$, sulfur content=0.52% by mass, saturated hydrocarbon content=46.3% by mass, total aromatic content=53.3% by mass Ca salicylate: base number=170 mg KOH/g, Ca content=6.0% by mass, metal ratio=2.3

Ca phenate: base number=255 mg KOH/g, Ca content=9.3% by mass, metal ratio=3.9

Ca sulfonate 1: base number=320 mg KOH/g, Ca content=12.5% by mass, metal ratio=10.7

Ca sulfonate 2: base number=20 mg KOH/g, Ca content=2.5% by mass, metal ratio=1.34

ZnDTP: compound that is primary, represented by the formula (3) where $R^3$ is 2-ethylhexyl group, with a P content of 7.4% by mass Ashless dispersant: polyisobutenyl succinimide, 38 mg KOH/g, nitrogen content=1.75% by mass The results for Examples a1 to a11 and Comparative Examples a1 to a6 show that, by including the metallic detergent (B) of 2.5 mmol or more as a soap content concentration per 100 g of the composition and setting the base number of the composition to 7.5 mg KOH/g or more, the high temperature detergency and anti-coking properties (thermal stability) of the lubricating oil composition were improved.

The results for Examples a1 to a4, a6, and a9 to a11 and Examples a5, a7, and a8 show that, by including Ca salicylate as the metallic detergent (B), the hydrolysis stability of the lubricating oil composition was improved significantly.

The above results show that a system oil with excellent high temperature detergency and anti-coking properties (thermal stability) can be provided by compounding a base oil (A) that has a kinematic viscosity at 100° C. of 8.2 $mm^2/s$ to 12.6 $mm^2/s$ and a saturated hydrocarbon content of 90% by mass or more with a metallic detergent (B) and a zinc dithiophosphate (C), where the metallic detergent (B) content is 2.5 mmol or more as a soap content concentration per 100 g of the composition, the phosphorous content is 200 mass ppm to 1000 mass ppm, and the base number is 7.5 mg KOH/g or more.

Reference Example b, Examples b1 to b16, Comparative Examples b1 to b14

Lubricating oil compositions with the formulations shown in Tables 3 to 5 were prepared, and a hot tube test in conformity with JPI-5S-55-99 and an oxidation stability test were performed. Tables 3 to 5 list the results. Note that in Tables 3 to 5, the amount of the base oil is the content in terms of total content of the base oil, whereas the amount of the additives is the content in terms of total content of the composition.

<Hot Tube Test>

Using mixed oils with 90% by mass of each test oil and 10% by mass of cylinder oil drip oil, a hot tube test was performed at 280° C. and 290° C. in conformity with JPI-5S-55-99, and assessment was performed by rating the depth of hue of the discolored portion in the test tube after the test (from 0 points (black) to 10 points (transparent=best)). A higher rating indicates better high temperature detergency. In Table 2, "obstructed" indicates that the glass tube was obstructed and that anti-coking properties were poor.

The cylinder oil drip oil that was used was collected from a crosshead diesel engine installed in a VLCC (Middle East—Japan), and the properties were a kinematic viscosity at 100° C. of 28.1 $mm^2/s$, an acid number of 7.5 mg KOH/g, a base number (perchloric acid method) of 24.1 mg KOH/g, and pentane insolubles (A method) of 6.0% by mass.

<ISOT Oxidation Stability Test>

The test was conducted under the conditions of 165.5° C. and 72 hours in conformity with the method of testing the oxidation stability of lubricating oil in internal combustion engines described in JIS K2514, to measure the kinematic viscosity ratio (viscosity ratio) at 40° C. before and after oxidation, the increase of the total acid number (acid number increase) after oxidation, and the holding rate (base number holding rate) of the base number (hydrochloric acid method) after oxidation. A lower viscosity ratio, a smaller acid number increase, and a higher base number holding rate indicate more excellent oxidation stability.

TABLE 3

| | | | Ref. Ex. b | Ex. b1 | Ex. b2 | Ex. b3 | Ex. b4 | Ex. b5 | Ex. b6 | Ex. b7 | Ex. b8 | Ex. b9 | Ex. b10 |
|---|---|---|---|---|---|---|---|---|---|---|---|---|---|
| Base oil | Mineral base oil 1 | % by mass | | 92 | 92 | 92 | 92 | 92 | 91 | 91 | 91 | 91 | 91 |
| | Mineral base oil 3 | % by mass | | | | | | | 9 | 9 | 9 | 9 | 9 |
| | Mineral base oil 5 | % by mass | 92 | | | | | | | | | | |
| | Mineral base oil 6 | % by mass | 8 | 8 | 8 | 8 | 8 | 8 | | | | | |
| Kinematic viscosity at 100° C. of base oil | | $mm^2/s$ | 11.7 | 11.7 | 11.7 | 11.7 | 11.7 | 11.7 | 11.7 | 11.7 | 11.7 | 11.7 | 11.7 |
| Saturated hydrocarbon content of base oil | | % by mass | 55.7 | 94.7 | 94.7 | 94.7 | 94.7 | 94.7 | 98.9 | 98.9 | 98.9 | 98.9 | 98.9 |
| Sulfur content of base oil | | % by mass | 0.61 | 0.04 | 0.04 | 0.04 | 0.04 | 0.04 | 0.00 | 0.00 | 0.00 | 0.00 | 0.00 |
| Additive | (B) Ca salicylate | % by mass | 3.8 | 4.1 | 4.1 | 4.1 | 4.1 | 4.1 | 4.1 | 4.1 | 4.1 | 4.1 | 4.1 |
| | (C) ZnDTP | % by mass | 0.57 | 0.57 | 0.57 | 0.57 | 0.57 | 0.57 | 0.57 | 0.57 | 0.57 | 0.57 | 0.57 |
| | (E) Amine-based antioxidant | % by mass | | 0.4 | 0.8 | 0.8 | 1.2 | 2.5 | 0.4 | 0.4 | 0.4 | 0.5 | 0.8 |
| | (F) Oil-soluble Mo compound 1 | % by mass | | | | 0.2 | | | 0.2 | | | 0.5 | 0.4 |
| | (F) Oil-soluble Mo compound 2 | % by mass | | | | | | | | 0.24 | | | |
| | (F) Oil-soluble Mo compound 3 | % by mass | | | | | | | | | 0.21 | | |
| Base number of composition (perchloric acid method) | | mgKOH/g | 6.5 | 7 | 7 | 7 | 7 | 7 | 7 | 7 | 7 | 7 | 7 |
| Ca content of composition | | % by mass | 0.23 | 0.245 | 0.245 | 0.245 | 0.245 | 0.245 | 0.245 | 0.245 | 0.245 | 0.245 | 0.245 |

TABLE 3-continued

| | | | Ref. Ex. b | Ex. b1 | Ex. b2 | Ex. b3 | Ex. b4 | Ex. b5 | Ex. b6 | Ex. b7 | Ex. b8 | Ex. b9 | Ex. b10 |
|---|---|---|---|---|---|---|---|---|---|---|---|---|---|
| Phosphorus content of composition | | % by mass | 0.042 | 0.042 | 0.042 | 0.042 | 0.042 | 0.042 | 0.042 | 0.042 | 0.042 | 0.042 | 0.042 |
| Mo content of composition | | mass ppm | 0 | 0 | 0 | 200 | 0 | 0 | 200 | 200 | 200 | 500 | 400 |
| Kinematic viscosity at 100° C. of composition | | $mm^2/s$ | 11.5 | 11.5 | 11.5 | 11.5 | 11.5 | 11.5 | 11.5 | 11.5 | 11.5 | 11.5 | 11.5 |
| ISOT 165.5° C. 72 h | Viscosity ratio (40° C.) | | 1.22 | 1.04 | 1.00 | 1.05 | 1.03 | 1.11 | 1.00 | 1.02 | 1.06 | 1.09 | 1.04 |
| | Acid number increase | mgKOH/g | 1.47 | 0.43 | 0.39 | 0.01 | 0.57 | 0.64 | −0.40 | −0.22 | −0.03 | 0.76 | 0.35 |
| | Base number (hydrochloric acid method) holding rate | % | 25 | 47 | 57 | 51 | 56 | 53 | 55 | 49 | 52 | 44 | 48 |
| Hot tube test | Rating (280° C.) | | 3.5 | 8.0 | 8.0 | 8.0 | 8.0 | 7.5 | 7.0 | 7.0 | 7.0 | 7.5 | 7.0 |
| | Rating (290° C.) | | 0.5 | 0.5 | 2.0 | 3.0 | 2.5 | 6.5 | 3.5 | 1.5 | 2.5 | 2.0 | 4.5 |

TABLE 4

| | | | Ex. b11 | Ex. b12 | Comp. Ex. b1 | Comp. Ex. b2 | Comp. Ex. b3 | Comp. Ex. b4 | Comp. Ex. b5 | Comp. Ex. b6 | Comp. Ex. b7 | Comp. Ex. b8 |
|---|---|---|---|---|---|---|---|---|---|---|---|---|
| Base oil | Mineral base oil 1 | % by mass | 91 | 91 | 92 | 92 | 92 | 91.5 | 92 | 91.5 | 92 | 92 |
| | Mineral base oil 3 | % by mass | 9 | 9 | | | | 8.5 | | 8.5 | | |
| | Mineral base oil 5 | % by mass | | | | | | | | | | |
| | Mineral base oil 6 | % by mass | | | 8 | 8 | 8 | | 8 | | 8 | 8 |
| Kinematic viscosity at 100° C. of base oil | | $mm^2/s$ | 11.7 | 11.7 | 11.7 | 11.7 | 11.7 | 11.6 | 11.7 | 11.6 | 11.7 | 11.7 |
| Saturated hydrocarbon content of base oil | | % by mass | 98.9 | 98.9 | 94.7 | 94.7 | 94.7 | 98.9 | 94.7 | 98.9 | 94.7 | 94.7 |
| Sulfur content of base oil | | % by mass | 0.00 | 0.00 | 0.04 | 0.04 | 0.04 | 0.00 | 0.04 | 0.00 | 0.04 | 0.04 |
| Additive | (B) Ca salicylate | % by mass | 4.1 | 4.1 | 3.2 | 4.1 | | | | | 4.1 | 4.1 |
| | (B) Ca phenate | % by mass | | | | | 2.75 | 3.35 | | | | |
| | (B) Ca sulfonate 1 | % by mass | | | | | | | 2.2 | 2.65 | | |
| | (C) ZnDTP | % by mass | 0.27 | 1.09 | 0.57 | 0.57 | 0.57 | 0.57 | 0.57 | 0.57 | 0.57 | 0.57 |
| | (E) Amine-based antioxidant | % by mass | 0.4 | 0.4 | | | | | | | | |
| | (F) Oil-soluble Mo compound 1 | % by mass | 0.2 | 0.2 | | | | | | | | |
| | (G) Phenol-based antioxidant | % by mass | | | | | | | | | 0.8 | 2.5 |
| Base number of composition (perchloric acid method) | | mgKOH/g | 7 | 7 | 5.5 | 7 | 7 | 8.5 | 7 | 8.5 | 7 | 7 |
| Ca content of composition | | % by mass | 0.245 | 0.245 | 0.19 | 0.23 | 0.255 | 0.312 | 0.275 | 0.331 | 0.245 | 0.245 |
| Phosphorus content of composition | | % by mass | 0.020 | 0.080 | 0.042 | 0.042 | 0.042 | 0.042 | 0.042 | 0.042 | 0.042 | 0.042 |
| Mo content of composition | | mass ppm | 200 | 200 | 0 | 0 | 0 | 0 | 0 | 0 | 0 | 0 |
| Kinematic viscosity at 100° C. of composition | | $mm^2/s$ | 11.5 | 11.5 | 11.5 | 11.5 | 11.5 | 11.5 | 11.5 | 11.5 | 11.5 | 11.5 |
| ISOT 165.5° C. 72 h | Viscosity ratio (40° C.) | | 1.03 | 1.00 | 1.02 | 1.03 | 1.12 | 1.09 | 1.2 | 1.17 | 1.02 | 1.01 |
| | Acid number increase | mgKOH/g | −0.26 | −0.22 | −0.40 | −0.35 | 0.64 | 0.53 | 1.36 | 1.42 | −0.21 | −0.40 |
| | Base number (hydrochloric acid method) holding rate | % | 57 | 45 | 45 | 48 | 38 | 41 | 27 | 31 | 61 | 63 |
| Hot tube test | Rating (280° C.) | | 7.0 | 6.5 | 0.0 | 0.5 | ob-structed | 2.0 | ob-structed | ob-structed | 8.5 | 8.5 |
| | Rating (290° C.) | | 3.5 | 2.5 | ob-structed | ob-structed | ob-structed | ob-structed | ob-structed | ob-structed | ob-structed | ob-structed |

TABLE 5

| | | | Comp. Ex. b9 | Comp. Ex. b10 | Comp. Ex. b11 | Comp. Ex. b12 | Comp. Ex. b13 | Comp. Ex. b14 | Ex. b13 | Ex. b14 | Ex. b15 | Ex. b16 |
|---|---|---|---|---|---|---|---|---|---|---|---|---|
| Base oil | Mineral base oil 1 | % by mass | 92 | 92 | 92 | 92 | 92 | 92 | 92 | 92 | 92 | 92 |
| | Mineral base oil 3 | % by mass | | | | | | | | | | |
| | Mineral base oil 5 | % by mass | | | | | | | | | | |
| | Mineral base oil 6 | % by mass | 8 | 8 | 8 | 8 | 8 | 8 | 8 | 8 | 8 | 8 |
| Kinematic viscosity at 100° C. of base oil | | $mm^2/s$ | 11.7 | 11.7 | 11.7 | 11.7 | 11.7 | 11.7 | 11.7 | 11.7 | 11.7 | 11.7 |
| Saturated hydrocarbon content of base oil | | % by mass | 94.7 | 94.7 | 94.7 | 94.7 | 94.7 | 94.7 | 94.7 | 94.7 | 94.7 | 94.7 |
| Sulfur content of base oil | | % by mass | 0.04 | 0.04 | 0.04 | 0.04 | 0.04 | 0.04 | 0.04 | 0.04 | 0.04 | 0.04 |
| Additive | (B) Ca salicylate | % by mass | 4.1 | 4.1 | 4.1 | 4.1 | 4.1 | 3.2 | 4.1 | 4.1 | 4.1 | 4.1 |
| | (C) ZnDTP | % by mass | 0.57 | 0.57 | 0.57 | 0.57 | 0.57 | 0.57 | 0.57 | 0.57 | 0.57 | 0.57 |
| | (E) Amine-based antioxidant | % by mass | | | | | 0.2 | 0.2 | 0.4 | 0.8 | 0.4 | 0.8 |
| | (F) Oil-soluble Mo compound 1 | % by mass | 0.2 | 0.4 | 0.8 | 1.2 | 0.1 | | 0.8 | 0.8 | | |
| | (G) Phenol-based antioxidant | % by mass | | | | | | 0.1 | | | 0.2 | 0.4 |
| Base number of composition (perchloric acid method) | | mgKOH/g | 7 | 7 | 7 | 7 | 7 | 5.5 | 7 | 7 | 7 | 7 |
| Ca content of composition | | % by mass | 0.245 | 0.245 | 0.245 | 0.245 | 0.245 | 0.19 | 0.245 | 0.245 | 0.245 | 0.245 |
| Phosphorus content of composition | | % by mass | 0.042 | 0.042 | 0.042 | 0.042 | 0.042 | 0.042 | 0.042 | 0.042 | 0.042 | 0.042 |
| Mo content of composition | | mass ppm | 200 | 400 | 800 | 1200 | 100 | 0 | 800 | 800 | 0 | 0 |
| Kinematic viscosity at 100° C. of composition | | $mm^2/s$ | 11.5 | 11.5 | 11.5 | 11.5 | 11.5 | 11.5 | 11.5 | 11.5 | 11.5 | 11.5 |
| ISOT 165.5° C. 72 h | Viscosity ratio (40° C.) | | 1.11 | 1.19 | 1.22 | 1.43 | 1.03 | 1.01 | 1.15 | 1.05 | 1.05 | 1.02 |
| | Acid number increase | mgKOH/g | 0.32 | 0.56 | 1.11 | 1.85 | 0.11 | −0.33 | 0.78 | 0.01 | 0.01 | 0.03 |
| | Base number (hydrochloric acid method) holding rate | % | 47 | 39 | 33 | 22 | 47 | 51 | 41 | 51 | 51 | 67 |
| Hot tube test | Rating (280° C.) | | obstructed | obstructed | obstructed | obstructed | 2.0 | 1.0 | 5.5 | 6.0 | 7.5 | 8.0 |
| | Rating (290° C.) | | obstructed | obstructed | obstructed | obstructed | obstructed | obstructed | 0.5 | 1.0 | 0.5 | 2.0 |

Mineral base oil 1: group II base oil, 500 N, kinematic viscosity at 40° C.=93.9 $mm^2/s$, kinematic viscosity at 100° C.=10.7 $mm^2/s$, sulfur content=0.00% by mass, saturated hydrocarbon content=98.9% by mass, total aromatic content=0.9% by mass Mineral base oil 3: group II base oil, 2050, kinematic viscosity at 40° C.=387 $mm^2/s$, kinematic viscosity at 100° C.=29.4 $mm^2/s$, sulfur content=0.00% by mass, saturated hydrocarbon content=99.1% by mass, total aromatic content=0.7% by mass Mineral base oil 5: group I base oil, 500 N, kinematic viscosity at 40° C.=95.3 $mm^2/s$, kinematic viscosity at 100° C.=10.8 $mm^2/s$, sulfur content=0.62% by mass, saturated hydrocarbon content=56.5% by mass, total aromatic content=42.9% by mass Mineral base oil 6: group I base oil, 2600 (bright stock), kinematic viscosity at 40° C.=481 $mm^2/s$, kinematic viscosity at 100° C.=31.7 $mm^2/s$, sulfur content=0.52% by mass, saturated hydrocarbon content=46.3% by mass, total aromatic content=53.3% by mass Ca salicylate: base number=170 mg KOH/g, Ca content=6.0% by mass, metal ratio=2.3

Ca phenate: base number=255 mg KOH/g, Ca content=9.3% by mass, metal ratio=3.9

Ca sulfonate 1: base number=320 mg KOH/g, Ca content=12.5% by mass, metal ratio=10.7

ZnDTP: compound that is primary, represented by the formula (3) where $R^3$ is 2-ethylhexyl group, with a P content of 7.4% by mass Amine-based antioxidant: IRGANOX 57, alkyl diphenylamine, a reaction product of N-phenylbenzenamine and 2,4,4-trimethylpentene Oil-soluble Mo compound 1: MoDTC, Mo content=10% by mass Oil-soluble Mo compound 2: MoDTP, Mo content=8.4% by mass Oil-soluble Mo compound 3: Mo-tridecylamine complex, Mo content=9.7% by mass Phenol-based antioxidant: IRGANOX L135, benzenepropanoic acid, 3,5-bis(1,1-dimethyl-ethyl)-4-hydroxy-, C7-C9 side-chain alkyl ester The results for Examples b1 to b16 and Comparative Examples b1 to b14 show that, by adding the amine-based antioxidant (E) of 0.3% by mass or more in terms of total content of the composition, the high temperature detergency and anti-coking properties (thermal stability) of the lubricating oil composition were improved.

The results for Comparative Examples b2, b7, and b8 show that the addition of the phenol-based antioxidant as an antioxidant did not sufficiently improve the anti-coking properties (thermal stability) of the lubricating oil.

The results for Examples b3 and b6 to b14 show that, by combining the amine-based antioxidant (E) and the oil-soluble molybdenum compound (F) and setting the addition amount of the oil-soluble molybdenum compound (F) in a range from 0.005% to 0.06% by mass as a molybdenum content in terms of total content of the composition, the synergistic effect for the high temperature detergency and the anti-coking properties (thermal stability) was attained.

On the other hand, the results for Examples b15 and b16 show that the combination of the amine-based antioxidant (E) and the phenol-based antioxidant did not produce such a synergistic effect.

The above results show that a system oil with excellent high temperature detergency and anti-coking properties (thermal stability) can be provided by compounding a base oil (A) that has a kinematic viscosity at 100° C. of 8.2 $mm^2/s$ to 12.6 $mm^2/s$ and a saturated hydrocarbon content of 90% by mass or more with a metallic detergent (B), a zinc dithiophosphate (C), and an amine-based antioxidant (E), where the amine-based antioxidant (E) content is 0.3% by mass or more in terms of total content of the composition, the base number is 6.5 mg KOH/g or more, and the phosphorous content is 200 mass ppm to 1000 mass ppm.

The invention claimed is:

1. A system lubricating oil composition for a crosshead diesel engine, comprising:

a base oil (A) with a kinematic viscosity at 100° C. of 8.2 $mm^2/s$ to 12.6 $mm^2/s$ and a saturated hydrocarbon content of 90% by mass or more;

a metallic detergent (B), wherein the metal is Ca; and a zinc dialkyldithiophosphate (C), wherein the base oil (A) includes a group II base oil and/or a group III base oil, the metallic detergent (B) comprises Ca salicylate, a content of the metallic detergent (B) is 2.5 mmol or more as a soap content concentration per 100 g of the composition, a content by percentage of the metallic detergent (B) is, in terms of total content of the composition, 8.0% by mass or less, a phosphorous content is 350 mass ppm to 1000 mass ppm, and a base number is 7.5 mg KOH/g or more and 15 mg KOH/g or less.

2. The system lubricating oil composition for a crosshead diesel engine according to claim 1, wherein the base number is 8.0 mg KOH/g or more and 15 mg KOH/g or less.

3. The system lubricating oil composition for a crosshead diesel engine according to claim 1, further comprising an ashless dispersant (D) of 0.04% to 0.2% by mass as a nitrogen content in terms of total content of the composition.

4. A system lubricating oil composition for a crosshead diesel engine, comprising:

a base oil (A) with a kinematic viscosity at 100° C. of 8.2 $mm^2/s$ to 12.6 $mm^2/s$ and a saturated hydrocarbon content of 90% by mass or more;

a metallic detergent (B), wherein the metal is Ca;

a zinc dialkyldithiophosphate (C); and an amine-based antioxidant (E), wherein the base oil (A) includes a group II base oil and/or a group III base oil, the metallic detergent (B) comprises Ca salicylate, a content by percentage of the metallic detergent (B) is, in terms of total content of the composition, 8.0% by mass or less, a content of the amine-based antioxidant (E) is 0.3% by mass or more in terms of total content of the composition, a base number is 6.5 mg KOH/g or more and 15 mg KOH/g or less, and a phosphorous content is 350 mass ppm to 1000 mass ppm.

5. The system lubricating oil composition for a crosshead diesel engine according to claim 4, further comprising an oil-soluble molybdenum compound (F) of 0.005% to 0.06% by mass as a molybdenum content in terms of total content of the composition.

6. The system lubricating oil composition for a crosshead diesel engine according to claim 2, further comprising an ashless dispersant (D) of 0.04% to 0.2% by mass as a nitrogen content in terms of total content of the composition.

7. The system lubricating oil composition for a crosshead diesel engine according to claim 4, wherein the base number is 7.0 mg KOH/g or more and 15 mg KOH/g or less.

* * * * *